US009835059B2

(12) United States Patent
Schützle

(10) Patent No.: US 9,835,059 B2
(45) Date of Patent: Dec. 5, 2017

(54) CAMSHAFT FOR AN INTERNAL COMBUSTION ENGINE AND USE THEREFORE

(71) Applicant: Dr. Ing. h.c. F. Porsche Aktiengesellschaft, Stuttgart (DE)

(72) Inventor: Artur Schützle, Neuenstadt-Stein a.K. (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 119 days.

(21) Appl. No.: 14/932,442

(22) Filed: Nov. 4, 2015

(65) Prior Publication Data

US 2016/0130990 A1 May 12, 2016

(30) Foreign Application Priority Data

Nov. 11, 2014 (DE) ..... 10 2014 116 450

(51) Int. Cl.
*F01L 1/04* (2006.01)
*F01L 13/00* (2006.01)

(52) U.S. Cl.
CPC ... *F01L 13/0036* (2013.01); *F01L 2013/0052* (2013.01)

(58) Field of Classification Search
CPC ..... F01L 13/0036; F01L 2013/0052
USPC ..... 123/90.16, 90.6, 90.44
See application file for complete search history.

(56) References Cited

U.S. PATENT DOCUMENTS

| | | | | |
|---|---|---|---|---|
| 4,798,178 | A * | 1/1989 | Greulich | F16H 53/025 123/90.6 |
| 8,807,106 | B2 * | 8/2014 | Johnson | B22D 19/00 123/90.6 |
| 8,863,714 | B1 | 10/2014 | Moran | |
| 8,960,143 | B2 * | 2/2015 | Meintschel | F01L 1/34 123/90.16 |
| 9,121,354 | B2 | 9/2015 | Kirbach | |
| 2014/0109851 | A1 | 4/2014 | Kirbach | |

FOREIGN PATENT DOCUMENTS

| | | |
|---|---|---|
| DE | 102009022657 | 1/2011 |
| DE | 102011000248 | 8/2012 |
| DE | 102011103544 | 12/2012 |

(Continued)

OTHER PUBLICATIONS

Korean Office Action for Korean Application No. 2020150007210, dated Jun. 1, 2016.

(Continued)

*Primary Examiner* — Ching Chang
(74) *Attorney, Agent, or Firm* — RatnerPrestia

(57) ABSTRACT

A camshaft for an internal combustion engine, with a drivable basic shaft and a cam piece which is mounted in the basic shaft, wherein the basic shaft passes through a passage in the cam piece, and the cam piece is mounted in the basic shaft in a rotationally fixed and axially displaceable manner. In the case of such a camshaft, it is provided that the basic shaft has a polygonal profile, and the passage in the cam piece has a complementary polygonal profile for receiving the basic shaft. The camshaft is preferably used in a motorcycle which has an internal combustion engine with two cylinders.

9 Claims, 3 Drawing Sheets

(56) References Cited

FOREIGN PATENT DOCUMENTS

| | | |
|---|---|---|
| EP | 0440314 | 8/1991 |

OTHER PUBLICATIONS

German Search Report for German Application No. 10 2014 116 450.4 dated Sep. 24, 2015, including partial translation.
Decker, K.H., "Maschinenelemente: Gestaltung and Berechnung", 8 Aufl., Munchen: Carl Hanser Verlag, 1982, Kapitel 12.5—ISBN 3-446-13558-8, pp. 189-190.

* cited by examiner

CAMSHAFT FOR AN INTERNAL COMBUSTION ENGINE AND USE THEREFORE

CROSS-REFERENCE TO RELATED APPLICATION

This application claims priority to German Patent Application No. DE 10 2014 116 450.4, filed Nov. 11, 2014, which is incorporated by reference herein in its entirety.

FIELD OF THE INVENTION

The invention relates to a camshaft for an internal combustion engine, with a drivable basic shaft and a cam piece which is mounted in the basic shaft, wherein the basic shaft passes through a passage in the cam piece, and the cam piece is mounted in the basic shaft in a rotationally fixed and axially displaceable manner. The invention furthermore relates to a particular use of a camshaft of this type.

BACKGROUND OF THE INVENTION

A camshaft of the type mentioned is known from DE 10 2011 103 544 A1, which is incorporated by reference herein. In said camshaft, the basic shaft is provided with an external toothing and the cam piece interacting with the basic shaft is provided with a complementary internal toothing. The torque introduced into the basic shaft is introduced by the latter via said toothings into the cam piece, in order to actuate one or more valves of the internal combustion engine. In the case of multi-tooth connection of this type, the basic shaft has a relatively low fatigue strength.

In DE 10 2011 000 248 A1, which is incorporated by reference herein, a camshaft with displaceable cam pieces is provided with connecting elements which are arranged spaced apart in an axial direction of the camshaft and serve for connecting a basic shaft to the cam piece. The connecting elements or individual elements of the connecting elements are designed as a sliding spring, four-groove profile or spline shaft section, serration profile, toothed shaft section, four-cornered profile, multi-cornered profile, polygonal profile and/or the like.

SUMMARY OF THE INVENTION

Described herein is a camshaft, and use therefore, of the type mentioned previously that is designed in such a manner that the basic shaft has a particularly high fatigue strength.

The basic shaft has a polygonal profile, and the passage in the cam piece has a complementary polygonal profile for receiving the basic shaft.

One particular advantage of the use of a basic shaft with a polygonal profile in the region of the torque transmission between basic shaft and cam piece can be seen in the fact that polygonal profiles do not have any stress concentration and therefore also the moments of inertia do not change. The basic shaft having the polygonal profile is therefore only subjected to a torsional stress. The basic shaft has a substantially higher fatigue strength in comparison to conventional basic shaft profiles, in particular spline shaft profiles of equivalent size.

According to a development of the invention, it is provided that the polygonal profiles of basic shaft and passage have an identical shape, wherein the cross section of the polygonal profile of the basic shaft is slightly smaller than the cross section of the polygonal profile of the passage. The basic shaft and the passage of the cam piece are therefore co-ordinated with each other in the region of the polygonal profiles in such a manner that the cam piece is mounted with play in the basic shaft and can be displaced axially with respect to the basic shaft with low adjustment forces.

It is provided preferably and in particular from the aspect of simple production that the polygonal profile is of substantially four-cornered, in particular square, design. Moreover, according to a development, it is provided that the polygonal profile has rounded corners. Furthermore, it is considered advantageous if the polygonal profile has an outwardly curved contour in the region connecting respective adjacent corners.

A camshaft for an internal combustion engine is therefore proposed, in which the cam piece can be displaced, under torque, longitudinally with respect to the basic shaft. The cam piece is self-centering with respect to the basic shaft. The mounting of the cam piece in the basic shaft is distinguished by little backlash. Alternating torques are minimal.

The basic shaft is preferably designed structurally in such a manner that it is connected in the region of one end to an externally driveable drive element. The torque is introduced into the basic shaft via said drive element. The cam piece preferably has a slotted guide element with at least one cam part. In particular, it is provided that the cam piece has two cam parts, wherein two valves are activatable by means of each cam part.

The camshaft is preferably used in a motorcycle, for example. The latter in particular has an internal combustion engine with two cylinders.

BRIEF DESCRIPTION OF THE DRAWING

Further features of the invention emerge from the dependent claims, the attached drawing and the description of the exemplary embodiment reproduced in the drawing, without being limited thereto. In the drawing:

DETAILED DESCRIPTION OF THE INVENTION

Figure 1:
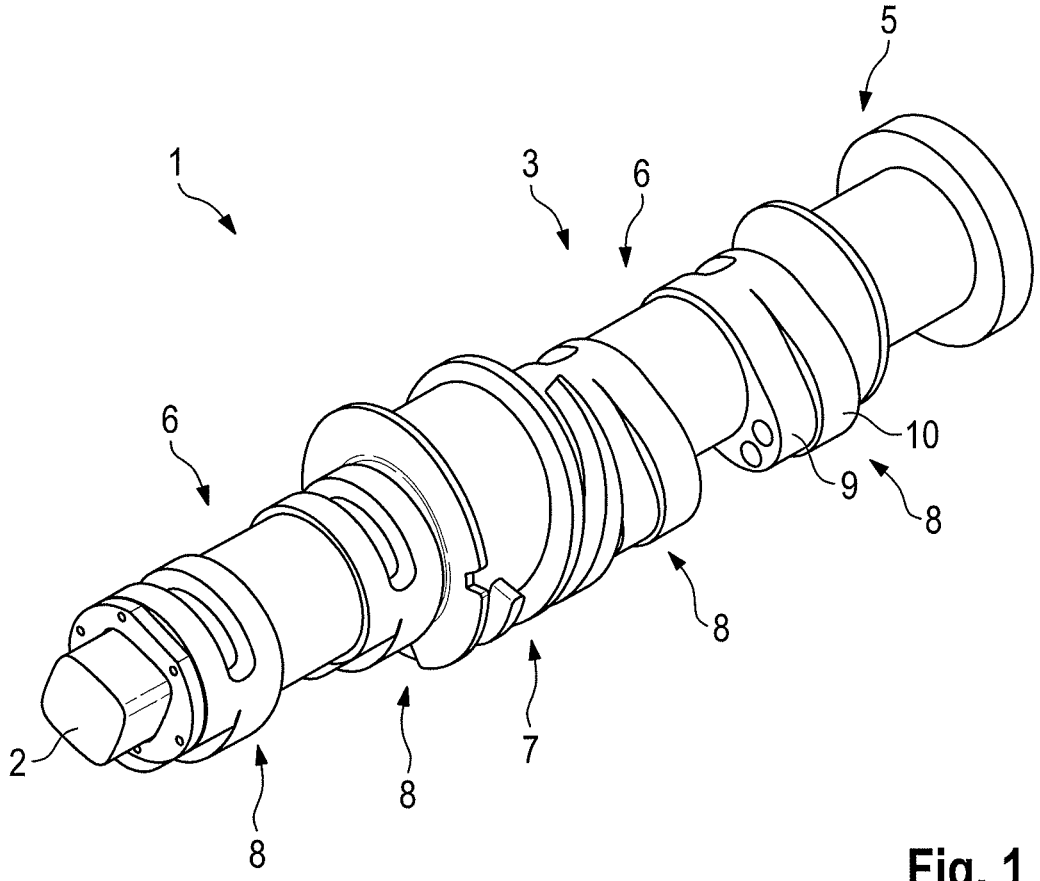
FIG. 1 shows a three-dimensional view of the camshaft according to aspects of the invention.

FIG. 1 illustrates a camshaft 1 for an internal combustion engine, this preferably being an internal combustion engine with two cylinders for use in a motorcycle.

Figure 3:
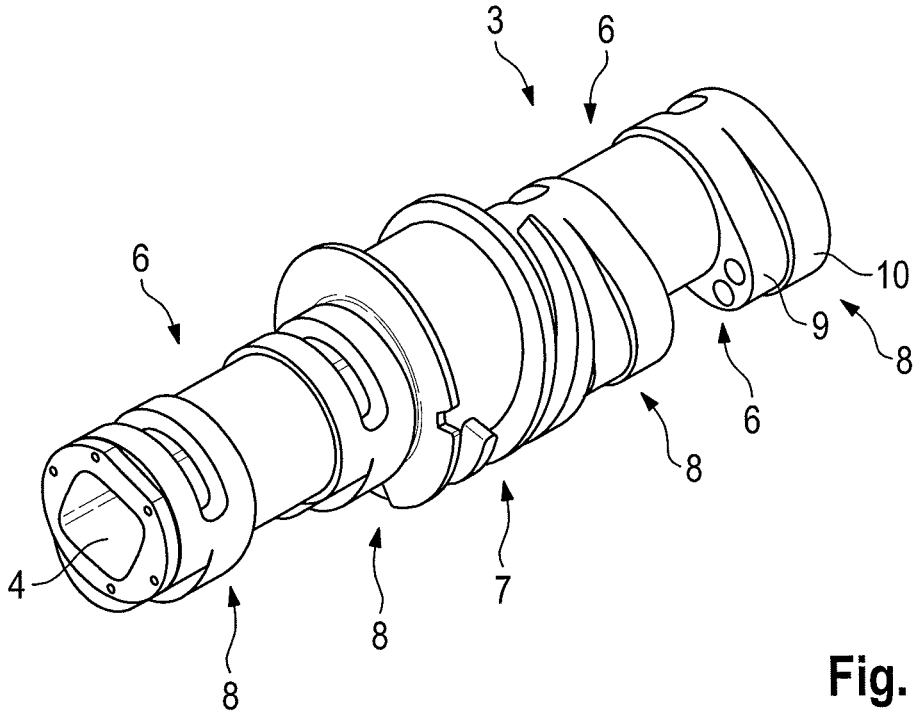
FIG. 3 shows a three-dimensional view of the cam piece used in the camshaft according to FIG. 1.

The camshaft 1 has a driveable basic shaft 2 and a cam piece 3 which is mounted in the basic shaft 2. The basic shaft 2 passes through a passage 4 in the cam piece 3. The cam piece 3 is mounted in the basic shaft 2 in a rotationally fixed and axially displaceable manner. In order to drive the basic shaft 2, the latter is connected in the region of one end to an externally driveable drive element 5. The cam piece 3 has, according to FIG. 3, two cam parts 6 and a slotted guide element 7 between the latter. Each cam part 6 is provided with two cam pairs 8. Each cam pair 8 has two cams 9, 10, wherein, as a consequence of axial displacement of the cam piece 3, the one cam 9 or the other cam 10 can be brought into engagement with an inlet valve or outlet valve of the internal combustion engine.

Figure 2:
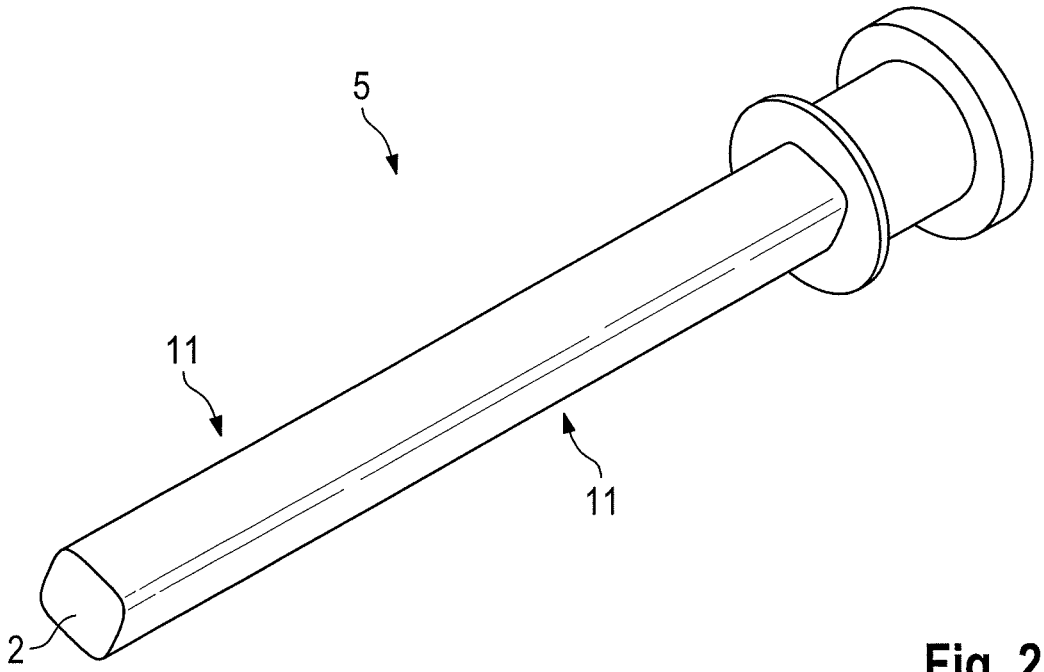
FIG. 2 shows a three-dimensional view of the basic shaft used in the camshaft according to FIG. 1.
Figure 4:
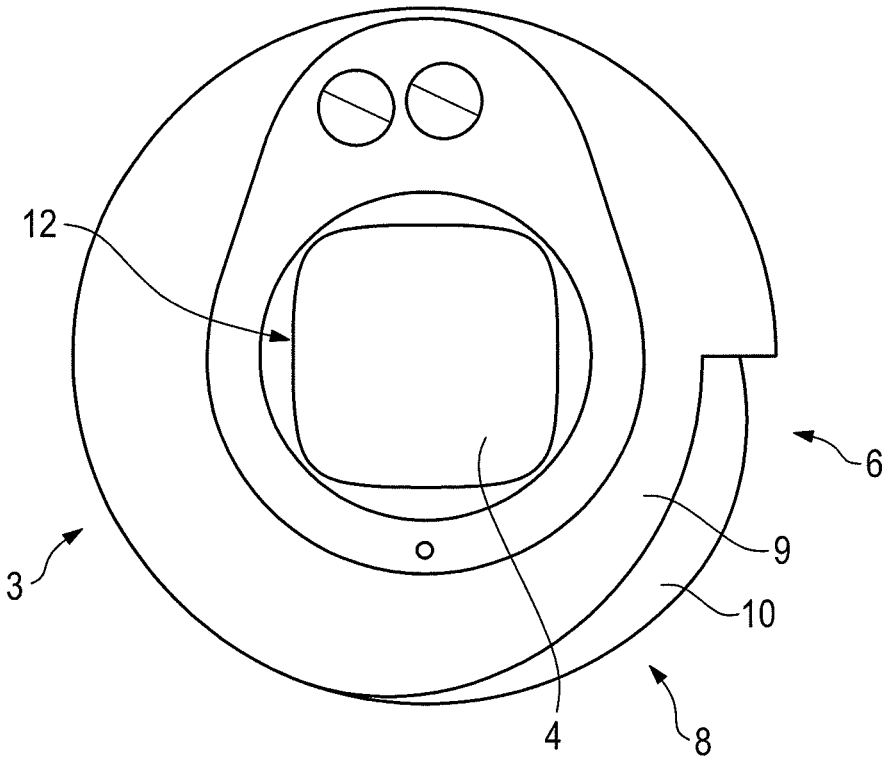
FIG. 4 shows a section through the cam piece, shown in FIG. 3, in a section perpendicular to the axis of rotation of the cam piece.

According to FIG. 2, the basic shaft 2 has a polygonal profile 11, and the passage 4 in the cam piece 3, has, according to FIG. 4, a complementary polygonal profile 12 for receiving the basic shaft 2. The polygonal profiles 11 and 12 are of identical configuration with respect to the cross-sectional design thereof, namely are of square design with rounded corners. That region of the polygonal profile 11 or 12 which connects respective adjacent corners has a slightly outwardly curved contour. The cross section of the polygonal profile 11 for the basic shaft 2 is somewhat smaller in size than the cross section of the polygonal profile 12 for the passage 4 of the cam piece 3. Accordingly, the cam piece 3 can be displaced with respect to the basic shaft 2 in the longitudinal extent thereof with play. The displacement of the cam piece 3 takes place in a known manner by means of slotted guide pins which can be brought into engagement with the slotted guide part 7.

LIST OF REFERENCE NUMBERS

1 Camshaft
2 Basic shaft
3 Cam piece
4 Passage
5 Drive element
6 Cam part
7 Slotted guide element
8 Cam pair
9 Cam
10 Cam
11 Polygonal profile
12 Polygonal profile

What is claimed is:

1. A camshaft for an internal combustion engine, with a drivable basic shaft and a cam piece which is mounted on the drivable basic shaft, wherein the drivable basic shaft is solid and passes through a passage in the cam piece, and the cam piece is mounted on the drivable basic shaft in a rotationally fixed and axially displaceable manner, wherein a perimeter of the drivable basic shaft has a polygonal profile, and a perimeter of the passage in the cam piece has a complementary polygonal profile for receiving the drivable basic shaft.

2. The camshaft as claimed in claim 1, wherein the polygonal profiles of the drivable basic shaft and the passage have an identical shape, wherein the cross section of the polygonal profile of the drivable basic shaft is smaller than the cross section of the polygonal profile of the passage.

3. The camshaft as claimed in claim 1, wherein each polygonal profile is of substantially square.

4. The camshaft as claimed in claim 1, wherein each polygonal profile has rounded corners.

5. The camshaft as claimed in claim 1, wherein each polygonal profile has an outwardly curved contour in a region connecting respective adjacent corners.

6. The camshaft as claimed in claim 1, wherein the drivable basic shaft is connected in the region of one end to an externally driveable drive element.

7. The camshaft as claimed in claim 1, wherein the cam piece has a slotted guide element and at least one cam part.

8. The camshaft as claimed in claim 7, wherein the cam piece has two cam parts, wherein two valves of the internal combustion engine are activatable by the two cam parts.

9. The use of a camshaft as claimed in claim 1 in a motor vehicle which has an internal combustion engine with two cylinders.

* * * * *